United States Patent [19]

Peterson

[11] 4,341,145

[45] Jul. 27, 1982

[54] ELECTRONIC PIPE VALVE

[76] Inventor: Richard H. Peterson, 11748 Walnut Ridge Dr., Palos Park, Ill. 60464

[21] Appl. No.: 190,001

[22] Filed: Sep. 23, 1980

[51] Int. Cl.[3] ..... G10D 9/04

[52] U.S. Cl. ..... 84/337; 361/413

[58] Field of Search ..... 84/334, 337–339, 84/341; 361/413

[56] References Cited

U.S. PATENT DOCUMENTS

| | | | |
|---|---|---|---|
| 2,635,138 | 4/1953 | Reisner | 84/337 |
| 3,138,052 | 6/1964 | Wick | 84/337 |
| 3,605,061 | 9/1971 | Martin | 361/413 X |

FOREIGN PATENT DOCUMENTS

| | | | |
|---|---|---|---|
| 2513637 | 10/1976 | Fed. Rep. of Germany | 84/337 |

*Primary Examiner*—Lawrence R. Franklin

*Attorney, Agent, or Firm*—Jones, Tullar & Cooper

[57] ABSTRACT

An electronically controlled pipe valve magnet is disclosed. The valve magnet is a solenoid which activates a movable armature to open and close the air flow passageway between a pipe organ wind chest and an individual pipe. The pipe valve is electronically operated by means of a control circuit mounted directly on the solenoid by means of a circuit board which is easily accessible and which may be quickly replaced in the event of circuit failure. The electronic control circuit allows the relatively high solenoid currents to be switched by means of a relatively small control signal, thereby reducing the size and weight of the control cable leading from a keyboard console to the numerous pipe valves in a wind chest. The control circuit is economical and safe for use in a wind chest, and, since relatively low control currents are required, a large number of magnets can be operated directly from a single key contact.

4 Claims, 5 Drawing Figures

ELECTRONIC PIPE VALVE

BACKGROUND OF THE INVENTION

The present invention relates, in general, to an improved pipe valve for use in the wind chest of a pipe organ, and more particularly to a unique control circuit and circuit board adapted for mounting on the pipe valve solenoid for convenient access, easy repair, lower current requirement, and greater reliability.

In a conventional pipe organ, the various pipes are arranged in closely spaced rows or ranks, with each pipe resting on and communicating with the interior of a wind chest. Air under constant pressure is supplied to the wind chest and flows into and through the various pipes under the control of individual pipe valves actuated by the organ keyboard. In early organs, the connection between the various keys and the individual pipe valves was essentially mechanical, with each key operating complex lever and rod arrangements to play a selected note. Although these mechanical systems were highly sophisticated and were capable of producing a surprisingly rapid response to manipulation of the keyboard, nevertheless the need for a mechanical interconnection limited the flexibility of the organ, since it was necessary to locate the keyboard console adjacent to or very close to the organ pipes.

To provide a greater degree of freedom in the location of the console, an electro-pneumatic system for controlling the flow of air to individual pipes was devised. This arrangement includes for each pipe a "chest magnet" and a corresponding leather pouch located within the wind chest. The pouch served as a diaphragm which carried the air value for the corresponding pipe, while the chest magnet controlled the flow of air to the leather pouch. The air flow to the pouch shifted the position of the valve and permitted a very rapid opening and closing of the selected pipe valve, without valve bounce. Although this system worked quite well, and in fact produced a sound which is still preferred by many listeners, nevertheless it was a complex arrangement, required a great deal of space, and was particularly susceptible to aging and drying of the leather and consequent failure of the individual valves. Organs utilizing electro-pneumatic systems of this type require periodic releathering, which is a complex, time consuming and expensive procedure.

To overcome the difficulties inherent in the electro-pneumatic valving arrangements, a direct type of electric valving was developed, wherein a solenoid is used to directly actuate a pipe valve. In this arrangement, the valve is mounted on the movable armature of the solenoid, whereby actuation of the solenoid serves to pull the valve head away from the passageway leading to the pipe, thereby providing a path for air from the wind chest into the organ pipe.

Although direct valving is simple and economical in comparison to electro-pneumatic valving, some difficulties are still experienced. In particular, the direct type of electric valving requires a high current for actuation and where the keyboard console is located some distance from the organ pipes, this high current requires the use of relatively large diameter wires leading to each magnet. This in turn results in large cables leading from the console to the wind chest. Such cables are not only hard to handle, but require a considerable amount of space, are expensive, and are unsightly. Furthermore, the large current requirements for such devices produces erosion of the keyboard contacts which control the current flow, thus producing constant maintenance problems and reducing the reliability of the direct type electric valves. An additional problem with this arrangement is the difficulty experienced by pipe organ repairmen who are familiar with the mechanical features of pipe organs, but who experience difficulty in diagnosing and repairing electrical problems, particularly where the problems involve failures of not only solenoids, but remotely located control contacts. These difficulties make repairs uncertain and their cost excessive.

In order to be able to produce smaller and more compact pipe organs, it is necessary to place organ pipes more closely together so as to conserve space, but the resultant crowding of the electrically operated valves makes the problems of reliability and repair even more acute, for closely-spaced solenoids placed side by side within an air chest are, under the best of circumstances, difficult to repair. Thus, there is a need for a reliable, compact, easy-to-repair and inexpensive direct-type electrically operated pipe valve which utilizes a relatively low control current to substantially eliminate the erosion of control contacts, will reduce the need for heavy, bulky control cables, and will provide an increased safety factor against fire hazards within the organ pipe environment.

SUMMARY OF THE INVENTION

The present invention overcomes the difficulties of the prior art electric valving for pipe organs by the provision of an electronic control circuit and circuit board for physical connection directly to the valve magnet, which provides a low current control for direct type electric valving, which reduces keyboard contact wear to permit reliable control of the organ pipes, and which permits simplified repair and replacement to reduce maintenance costs.

Briefly, and in accordance with a preferred embodiment, the present invention includes a direct-type electrically operated pipe valve magnet on which is mounted an electronic circuit board assembly. The circuit board is mechanically supported on the magnet by the electrical leads by means of which current is supplied to the solenoid coil, whereby connection of the control circuit to the solenoid can be accomplished rapidly and easily by repairmen unskilled in electronics.

The control circuit carried by the circuit board includes a driver transistor and associated components to produce a very compact and extremely sensitive switching circuit which may be remotely controlled by way of low current control signals from a remotely located keyboard. The low current required for the circuit board reduces the size of the cable required to operate the organ pipes, and since with this invention each key contact can handle the current requirements for forty or more valve solenoids, the present invention greatly simplifies the switching requirements for octave coupling, unification, and like arrangements commonly provided in a pipe organ. Thus, many ranks of pipes can be operated from a single set of key switch contacts without overloading the contacts. Further, the small control currents allow the use of very fine control wiring and small cables of almost unlimited length to provide substantial economy in the manufacture of the organ and improved flexibility in the location of the organ pipes with respect to the keyboard console.

The mechanical arrangement of the circuit board, with its mounting on the solenoid for the valve, is specifically designed to facilitate repair and servicing. Because direct-type electric valves are mounted upside down on the undersurface of the top of a wind chest so that each valve has direct access to the passageway leading from the chest to the organ pipes which rest on the chest lid, access to the valves is very difficult. The only practical way to reach them is to remove the bottom of the wind chest so a repairman usually finds that he must work over his head. Further, the valve magnets are located in very close array so that there is not much space available for a repairman. However, in accordance with the invention, the circuit board is mounted on a pair of terminal lugs which extend from the solenoid coil, the lugs extending into corresponding apertures in the form of slots or notches formed in or at each end of the circuit board. This terminal lug and aperture arrangement permits quick mounting and demounting of the board, since the board can be secured in place by a pair of simple solder connections. The terminal lugs are connected to the ends of the solenoid windings and the solder connection which mechanically secures the board also provides easy interconnection of the control circuit carried on the board with the ends of the solenoid coil. Furthermore, the board is provided with eyelets, or plated-through apertures, on the circuit board which allow easy connection of the circuit components by means of a simple soldering operation.

Because overheating or short-circuiting of electrical components could conceivably cause a fire, especially in the favorable atmosphere of a wind chest, it is important that the electronic circuitry be provided with a fuse arrangement which will immediately cut off all power to the solenoid in the event of a problem. In accordance with the invention, this fusing is provided by a simple wire shunt arrangement that provides a positive disconnection of the circuit in the event of an overcurrent.

BRIEF DESCRIPTION OF THE DRAWINGS

The foregoing and additional objects, features and advantages of the present invention will become apparent to those skill in the art from the following detailed description of a preferred embodiment, taken in conjunction with the accompanying drawings, in which.

DESCRIPTION OF PREFERRED EMBODIMENT

Figure 1:
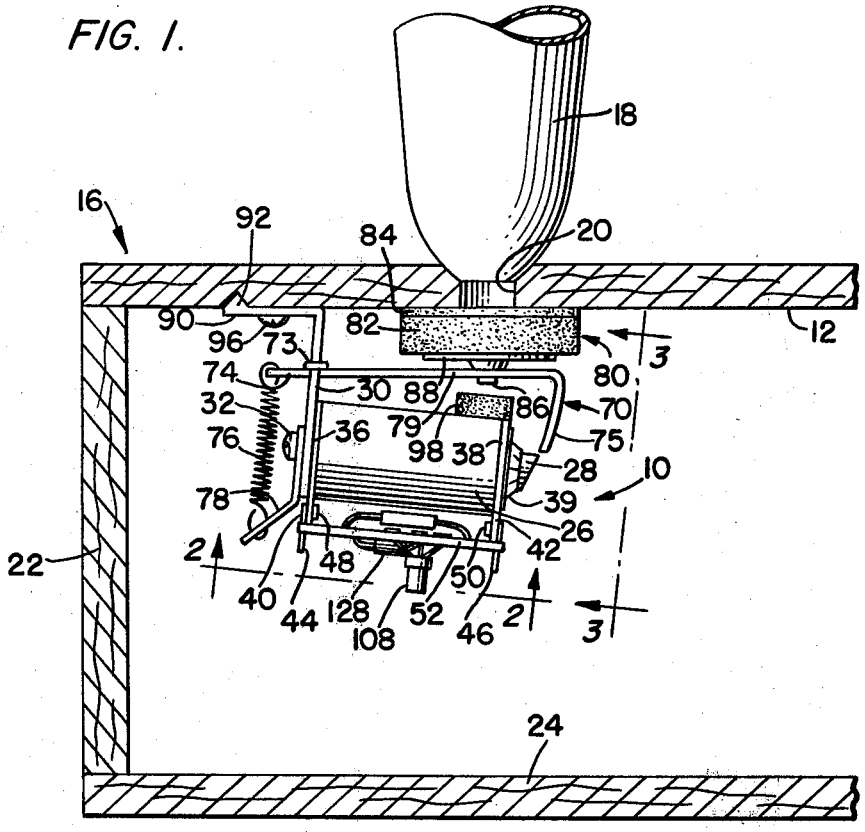
FIG. 1 is a partial cross-section of a wind chest for a pipe organ showing the electronic pipe valve arrangement of the present invention.

Turning now to a more detailed consideration of the present invention, reference is made to FIG. 1 wherein an electronic pipe valve assembly constructed in accordance with the invention is generally indicated at 10. Although only a single valve assembly is shown, it will be understood that a plurality of such valve assemblies are mounted to the undersurface 12 of the top wall 14 of a conventional wind chest 16. The wind chest, which receives air under regulated pressure from a suitable source (not shown) supplies that air to each of a plurality of organ pipes such as pipe 18 through corresponding passageways such as aperture 20 formed in the top wall 14. The pipe 18 rests on wall 14 in a conventional manner in communication with aperture 20, valve assembly 10 being so mounted as to normally close aperture 20. Whenever an organist wishes to activate pipe 18, the corresponding valve assembly 10 is energized to open aperture 20 and allow air to flow from the interior of the wind chest through pipe 18, in known manner.

The wind chest 16 is enclosed by side walls such as that illustrated at 22, and by a bottom wall 24. Conventionally, the wind chest is mounted so as to permit removal of the bottom wall 24, or a portion thereof, to permit access to the pipe valve mounted thereon. It will be understood, of course, that the wind chest may be of any desired size, and normally will carry a large number of pipes and their accompanying pipe valves, the pipes being spaced in accordance with their size, the appearance desired for the organ pipe ranks, the amount of space available, and like factors. The close spacing of the pipes results in closely spaced pipe valve assemblies, which causes difficulties in repair and maintenance.

The pipe valve assembly 10 includes, in a preferred form, a solenoid coil 26 wrapped around a core 28 and secured to an L-shaped mounting frame 30, as by a mounting screw 32. The coil includes a pair of end covers 36 and 38 which enclose the ends of the coil, with end covers 36 being held in place by bracket 30 and screw 32, and with end cover 38 being held in place by a push nut 39 on core 28. It should be understood, however, that the coil may be wound on a conventional bobbin, in which case separate end covers may not be required. The covers 36 and 38 include upstanding shoulder portions 40 and 42 on which are mounted corresponding electrical terminal lugs 44 and 46. The terminal lugs are electrically connected to opposite terminals 48 and 50, respectively, of the solenoid coil 26.

Figure 2:
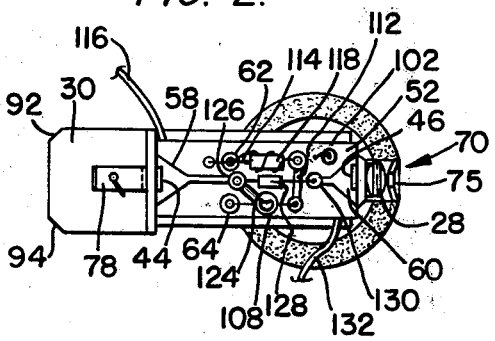
FIG. 2 is a top view of the electronic pipe valve of the invention taken along line 2—2 of FIG. 1.
Figure 3:
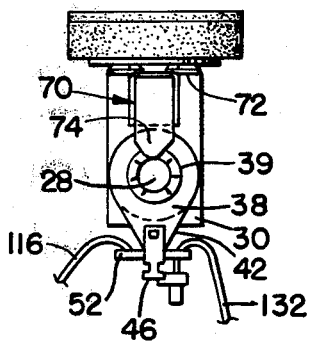
FIG. 3 is an end view of the electronic pipe valve of the invention taken along line 3—3 of FIG. 1.
Figure 4:
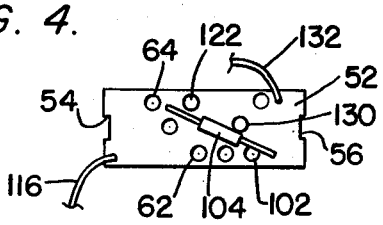
FIG. 4 is a view of the reverse side of the circuit board of the invention.

Secured to the terminal lugs 44 and 46 is a circuit board 52, illustrated in greater detail in FIGS. 2 and 4, which is generally rectangular in shape but which includes a pair of apertures in the form of end notches 54 and 56 adapted snugly to receive corresponding terminal lugs. As shown in FIGS. 2 and 3, the width of the circuit board 52 is approximately equal to the diameter of the solenoid coil so that the board is of substantially the same size as the planar projection of the solenoid. This insures that the circuit board will require no more space than the solenoid itself so that it will fit in the available space, will be easy to repair or replace, and will allow access to the solenoid 26 and the pipe valve to be described.

As illustrated in FIG. 2, the circuit board preferably includes a printed circuit having terminal portions 58 and 60 of conductive material surrounding the notches 54 and 56. This conductive material is located at, and preferrably in, the notches to engage the terminal lugs 44 and 46 when the circuit board is positioned on the solenoid so that the board can be secured in place by a small amount of solder at the juncture of the terminal lugs and the printed circuit portions. This arrangement insures a simple yet secure method of mounting the board on the solenoid, and at the same time insures good electrical contact between the circuit carried by the board and the solenoid coil 26. Since the notches 54 and 56 are designed to snugly receive the terminal lugs 44 and 46, respectively, the circuit board is held in position mechanically when it is placed on the solenoid so that it becomes a simple matter to secure and electrically connect the board by means of a drop of solder at each terminal. The simplicity of this operation allows even unskilled repairmen to connect or disconnect the circuit board quickly and easily and to obtain reliable connections in the cramped environment of a wind chest, even though the work must be done with the pipe valve upside down.

With reference to the circuit board, it will be further noted that the various circuit components to be described are mounted on the board by means of suitable leads extending to eyelets, or conductively plated apertures, such as those illustrated at 62 and 64, for example. These eyelets pass completely through the circuit board 52 to permit connection of components from either side of the board, and are filled with solder to secure and interconnect these components. This arrangement facilitates assembly of the circuit board as well as its repair by permitting simple disconnection and removal of individual components.

Returning to FIG. 1, the solenoid assembly 10 further includes a movable armature 70 which is pivotally mounted on frame 30 by a suitable pivot pin 72 which passes through a hinge bracket 73 mounted near a first end 74 of the armature. The second end of the armature, opposite the location of the pivot pin 72, is curved around the end of solenoid 26 so that its second end portion 75 is in proximity to the core 28. The armature is biased away from core 28 by means of a suitable bias spring 76 secured between end 74 of the armature and a spring bracket 78 which may be a part of the mounting bracket 30 or may be secured thereto by screw 32.

Mounted at a median point 79 on the armature 70 is a valve head 80, which may include a felt layer 82 and a leather contact layer 84 secured, as by an adhesive, to the surface of the felt layer. The valve head 80 may be mounted on the armature 70 by means of a rivet or other suitable fastener 86 which secures the felt layer to a backing plate 88 and thence to the armature 70.

The valve assembly is secured to the undersurface of wall 14 by means of the L-shaped bracket 30, which includes a mounting foot portion 90, as illustrated in FIGS. 1 and 2. The mounting foot portion preferably has its corners 92 and 94 folded downwardly so that they can be pressed into the wall 14, which preferably is of wood, upon mounting of the assembly. This allows a single fastener such as screw 96 to secure the valve in place, with the turned-down portions preventing it from rotating.

When the valve assembly 10 is mounted on the undersurface of the lid 14 of the wind chest, as illustrated in FIG. 1, the mounting bracket 30 causes the solenoid 26 and core 28 to angle away from surface 12 so that when the valve head 80 engages surface 12, armature 70 will be spaced away from core 28. Spring 76 biases the valve head against surface 12 to close off passageway 20, and the wind pressure within wind chest 16 helps to hold the valve in place. Upon energization of solenoid 26, armature 70 is pulled downwardly, as viewed in FIG. 1, toward alignment with core 28, thereby pulling valve head 80 away from passageway 20 and allowing air to flow into pipe 18. To prevent noise and valve bounce upon opening of the valve, a felt cushion 98 is secured, by suitable adhesive to the outside surface of the solenoid 26, in the path of armature 70. The thickness of the felt pad 98 is sufficient to prevent noise while at the same time allowing the desired motion of the valve head 80.

Figure 5:
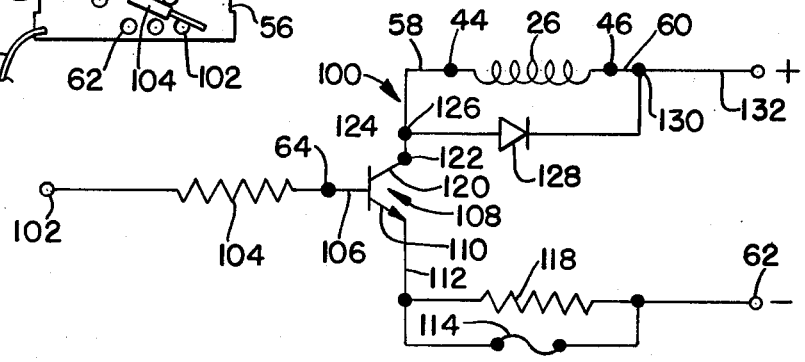
FIg. 5 is a schematic diagram of the control circuit used with the electronic pipe valve.

Energization of solenoid 26 is accomplished by means of a control circuit 100, schematically illustrated in FIG. 5 and diagrammatically shown in the various views of the circuit board 52 shown in FIGS. 1, 2 and 4, the FIG. 3 illustration of the circuit board omitting the circuit components. The control circuit includes an input terminal 102 to which is connected an input resistor 104. The other end of resistor 104 is connected through eyelet 64 to the base electrode 106 of a driver transistor 108, whereby control signals applied to terminal 102 by way of a control lead (not shown) from the keyboard console can regulate the operation of the solenoid.

The emitter 110 of driver transistor 108 is connected by way of line 112 through a fuse 114 to a source of direct current power connected to eyelet 62. The circuit board is connected to the power source by means of a lead 116 to a suitable buss provided at the wind chest. It should be noted that the fuse 114 may be a very fine wire supported by, and wrapped around, a high resistance resistor 118, the high resistance value of resistor 118 preventing significant current from flowing through solenoid 26 in the event fuse 114 opens.

The collector 120 of driver transistor 108 is connected by way of eyelet 122, a printed circuit portion 124 and an eyelet 126 to one end of a diode 128 and to the printed circuit portion 58. As previously explained, printed circuit portion 58 provides a connection from eyelet 126 by way of the terminal lug 44 to the terminal end 48 of solenoid coil 26. The opposite end of coil 26 is connected by way of its terminal end 50, terminal lug 46 and printed circuit portion 60 to eyelet 130, and thence to the other end of diode 128, whereby the diode shunts coil 26 to prevent "fly back" transients. That could damage the switching transistor 108. An additional effect of the diode is to retard the mechanical closure of the solenoid to prevent valve bounce that would be heard in the speech of the pipe. Also connected to eyelet 130 by way of printed circuity portion 60 is lead line 132 which is adapted to be connected to a suitable direct current buss (not shown) to provide power to the solenoid.

By utilizing relatively short leads 116 and 132 to supply DC power to the control circuit 100 from power busses located at or near the wind chest, and by utilizing a control lead connected to terminal 102 to regulate the application of power to solenoid 26, the valve assembly 10 can be operated from a remote distance by a suitable keyboard contact and a relatively thin control wire without the need of heavy power cables extending from the console to the organ pipe location. Thus, a considerable reduction in the amount of wire and in the complexity of the connecting cables is attained by use of the control circuit of the present invention and by locating that control circuit at the solenoids.

From the foregoing it will be seen that by mounting electronic control circuitry for a pipe valve assembly on the valve solenoid, and by controlling the operation of the solenoid by means of a remotely located source of control signals, while supplying power from localized power busses, a more efficient and more effective control of organ pipes can be obtained. In addition, great savings in the cost of installing the cables, a considerable reduction in the bulk and weight of such cables, and greater flexibility in switching control can be obtained. By mounting the control circuit on a small and easily accessible circuit board which is mounted on terminal lugs provided at the solenoid itself, a simplified assembly is provided which can be maintained and repaired by relatively unskilled personnel. The simple constructin of the circuit board and its connection to the solenoid enables it to be located within a wind chest and yet remain reasonably accessible to a repairman so that maintenance can be carried out with a minimum of difficulty.

Although the present inventio has been described in terms of a preferred embodiment, it will be understood that numerous variations can be made. For example, the circuit board can be fastened to solenoid pipe valves of different configuration than that illustrated, and may be mounted on terminal lugs located differently than those shown in the drawings. For example, the solenoid coil can be mounted with its axis substantially vertical and with the terminal lugs located at opposite ends, as in the illustrated embodiment, so that the circuit board would also be vertical. Alternatively, the terminal lugs could be relocated to one end of the vertically-mounted coil, so that the circuit board would be mounted perpendicular to the coil axis. Such an arrangement would require rearrangement of the circuit components on the circuit board, since the terminal lugs would be closer together and the mounting apertures would either be in the form of notches on the sides of the board or in the form of slots in the board.

These and such other modifications and variations as will be evident to those of skill in the art are within the true spirit and scope of the invention as defined in the following claims.

What is claimed is:

1. An electronic pipe valve assembly for pipe organs, comprising:

a mounting bracket adapted to secure the assembly within the wind chest of a pipe organ;

solenoid means mounted on said bracket, said solenoid means including a coil having first and second terminals;

first and second spaced terminal lug means secured to and located at opposite ends of said solenoid means and electrically connected to said first and second terminals of said coil, respectively;

armature means adapted for movement by the energization and deenergization of said coil;

pipe valve means mounted on said armature for controlling the flow of air from the wind chest to the pipes of a pipe organ;

control means for said solenoid means, said control means including an electronic control circuit mounted on a circuit board approximately equal in area to the planar projection of said coil, whereby said circuit board is easily accessible without impeding access to said coil, said armature, or said pipe valve means, said control means further including a control lead connected to said control circuit for supplying control signals to regulate the energization and deenergization of said coil and power leads connected to said control circuit for supplying power to energize said coil; and connector means including first and second notches on said circuit board adapted to receive and engage said first and second terminal lugs, respectively, for mechanically mounting said circuit board on said solenoid means and further including printed circuit means on said circuit board and located at said first and second notches for electrically connecting said control circuit to said first and second terminal lug means.

2. The assembly of claim 1, wherein said armature means is pivotally secured to said mounting bracket for motion with respect to said coil upon energization and deenergization thereof.

3. The assembly of claim 1, wherein said control circuit includes fuse means in one of said power leads, said fuse means comprising a fuse wire wrapped around a component of said control circuit.

4. The assembly of claim 1, wherein said circuit connector means includes printed circuit means on said circuit board for providing electrical connections between said electronic control circuit and said coil, said printed circuit means including electrically conductive eyelets extending through said circuit board for connecting electrical circuit components to said board.

* * * * *